US008043164B2

(12) United States Patent
Hennessey

(10) Patent No.: US 8,043,164 B2
(45) Date of Patent: Oct. 25, 2011

(54) APPARATUS FOR IMPROVING A GOLF SWING

(76) Inventor: Brian Hennessey, Barrington, RI (US)

( * ) Notice: Subject to any disclaimer, the term of this patent is extended or adjusted under 35 U.S.C. 154(b) by 0 days.

(21) Appl. No.: 12/757,037

(22) Filed: Apr. 8, 2010

(65) Prior Publication Data

US 2010/0311515 A1 Dec. 9, 2010

Related U.S. Application Data

(60) Provisional application No. 61/167,642, filed on Apr. 8, 2009.

(51) Int. Cl.
*A63B 69/36* (2006.01)

(52) U.S. Cl. ..... 473/257; 473/266; 473/409

(58) Field of Classification Search ..... 473/219, 473/257–266, 275, 276, 422, 453, 409
See application file for complete search history.

(56) References Cited

U.S. PATENT DOCUMENTS

| | | | | | |
|---|---|---|---|---|---|
| 2,690,911 | A | * | 10/1954 | Newgren | 473/271 |
| 3,482,838 | A | * | 12/1969 | Gibson et al. | 473/264 |
| 3,595,583 | A | | 7/1971 | Oppenheimer | |
| 3,730,531 | A | | 5/1973 | Zega | |
| 3,744,799 | A | | 7/1973 | Hightower | |
| 3,870,315 | A | * | 3/1975 | Lawlor et al. | 473/264 |
| 4,071,251 | A | * | 1/1978 | Beckish | 473/259 |
| 4,315,626 | A | | 2/1982 | Hamm | |
| 4,736,952 | A | | 4/1988 | Taft et al. | |
| 4,758,000 | A | | 7/1988 | Cox | |
| 4,852,881 | A | | 8/1989 | Bellagamba et al. | |
| 4,921,254 | A | | 5/1990 | Buckley et al. | |
| 4,927,152 | A | * | 5/1990 | Graham | 473/265 |
| 4,998,731 | A | | 3/1991 | Bowen | |
| 5,062,640 | A | | 11/1991 | Haley | |
| 5,087,039 | A | * | 2/1992 | Laseke | 473/417 |
| 5,362,059 | A | | 11/1994 | Grossman | |

(Continued)

FOREIGN PATENT DOCUMENTS

DE 20306365 U1 4/2003

(Continued)

OTHER PUBLICATIONS http://www.intheholegolf.com/store/plane-traind.html#description Downloaded on Jan. 19, 2009 Plane Trainer Deluxe Works on key positions without mechanical thoughts. Totally adjustable.

(Continued)

*Primary Examiner* — Nini Legesse
(74) *Attorney, Agent, or Firm* — Russ Weinzimmer; Russ Weinzimmer & Associates PC

(57) ABSTRACT

A training apparatus for improving a golfer's golf swing is disclosed. The training apparatus can restrict movement of the golfer's hands, as well as the shaft of the golfer's golf club, during the swing. A set of rails supported by a support structure are oriented so as to restrict the golfer's hand movement, and golf club shaft movement. The set of rails include at least two rails for inducing the golfer to move the golfer's hands within the hand space, throughout at least a portion of the swing, and at least two rails for inducing the golfer to move the golfer's golf club shaft within the golf club shaft space. The rails can include various adjustability features, allowing for adjusting the height and angular orientation of the set of rails, as well as the spacing and orientation of individual rails relative to each other.

21 Claims, 19 Drawing Sheets

U.S. PATENT DOCUMENTS

| | | | |
|---|---|---|---|
| 5,429,367 | A | 7/1995 | Amos |
| 5,529,305 | A | 6/1996 | Wu |
| 5,634,858 | A | 6/1997 | Bellagamba |
| 5,707,300 | A | 1/1998 | May et al. |
| 6,343,998 | B1 | 2/2002 | Tarulli et al. |
| 6,497,627 | B2 | 12/2002 | Collins |
| 6,843,730 | B1 | 1/2005 | Bellagamba |
| 6,855,065 | B1 | 2/2005 | Hamilton |
| 6,932,712 | B2 | 8/2005 | Cardosi |
| 7,052,408 | B1 | 5/2006 | Leonard |
| 7,150,683 | B2 | 12/2006 | Bender |
| 7,172,515 | B2 | 2/2007 | Costa et al. |
| 7,207,895 | B2 | 4/2007 | Canakes |
| 7,431,661 | B1 | 10/2008 | Cailey |
| 7,465,242 | B2 | 12/2008 | Ward et al. |

FOREIGN PATENT DOCUMENTS

| | | | |
|---|---|---|---|
| JP | 04064375 | A | 2/1992 |
| JP | 04361762 | A | 12/1992 |
| JP | 10085375 | A | 4/1998 |
| JP | 11188127 | A2 | 7/1999 |
| WO | 9209336 | A1 | 6/1992 |
| WO | 2008136162 | A1 | 11/2008 |

OTHER PUBLICATIONS http://www.superswingtrainer.com/ Downloaded on Jan. 19, 2009 New Deluxe Putting Aid.

* cited by examiner

APPARATUS FOR IMPROVING A GOLF SWING

CROSS-REFERENCE TO RELATED APPLICATION

This application claims priority to U.S. Provisional Patent Application 61/167,642, having a filing date of Apr. 8, 2009, entitled, "Apparatus for Improving a Golf Swing", which is incorporated herein by reference in its entirety.

FIELD

The invention relates to golf equipment, and more particularly to golf training equipment.

BACKGROUND

Golfing is a popular recreational sport, and many golfing enthusiasts are highly motivated to improve their golfing skills. The golf swing is the most essential part of the game of golf. A swing that is executed with even a small error can translate into great error in the game, since the golf swing precisely dictates the trajectory of the golf ball hit by the golf club during the swing.

Apparatuses for guiding a golfer's golf swing are known in the art. Some of these apparatuses employ a system of rails or cables so as to restrict some or all of the movement of a golfer's swing. However, these apparatuses do not appropriately restrict the golfer's swing, instead leaving too much of the swing's movement to the freedom of the golfer.

SUMMARY

A training apparatus for improving a golfer's golf swing is claimed. The training apparatus can restrict movement of the golfer's hands, as well as the shaft of the golfer's golf club, during the swing. A set of rails supported by a support structure are oriented so as to restrict the golfer's hand movement, and golf club shaft movement. The set of rails include at least two rails which describe a hand space, for inducing the golfer to move the golfer's hands within the hand space, throughout at least a portion of the swing. The set of rails also include at least two rails which describe a golf club shaft space, for inducing the golfer to move the golfer's golf club shaft within the golf club shaft space. A training apparatus for improving a golfer's golf swing is claimed, the training apparatus comprising a support structure, and a set of rails supported by the support structure, the set of rails including at least two rails describing a hand space, for inducing the golfer to move the golfer's hands within the hand space throughout at least a portion of the golf swing, and at least two rails describing a golf club shaft space, for inducing the golfer to move a golf club shaft within the golf club shaft space throughout at least a portion of the golf swing, the hand space being wider than the golf club shaft space. In some embodiments, at least one of the height of the set of rails, and the angular orientation of the set of rails, is adjustable. In some embodiments, the length of at least one rail is adjustable. In some embodiments, the rails can be adjusted so as to change the spacing between the rails. Some embodiments further comprise hinge joints capable of adjusting the angle between two rails.

In some embodiments, the set of rails includes at least one of a pair of hand rails, the pair of hand rails being configured so as to induce a golfer to move the golfer's hands within the appropriate space described by the hand rails throughout the entire golf swing; and a pair of golf club shaft rails, the pair of golf club shaft rails being configured so as to induce a golfer to move a golf club shaft within the appropriate space described by the club shaft rails throughout the extended portion of the golf swing. In some embodiments, at least one of the pair of hand rails, and the pair of golf club shaft rails, includes at least one of straight rails, and parallel rails. In some embodiments, at least one of the width between each hand rail of the pair of hand rails, and the width between each golf club shaft of the pair of golf club shaft rails, is adjustable.

In some embodiments, the distance between a hand rail and a golf club shaft rail is adjustable. In some embodiments, the pair of golf club shaft rails includes a bumper that connects the distal ends of the golf club shaft rails together, so as to induce a golfer to avoid extending a golf club past the distal ends of the golf club shaft rails during the extended portion of the golf swing. In some embodiments, the golf club shaft rails protrude beyond the point where they are joined with the hand rails.

A method of improving a golf swing is also claimed, comprising providing an apparatus for improving a golf swing that includes a support structure and a set of rails supported by the support structure, wherein the set of rails is configured so as to induce a golfer to move at least one of the golfer's hands, and a golf club shaft, within the appropriate space described by the set of rails throughout at least the extended portion of the golf swing, and allowing a golfer to practice a golf swing, whereby the golfer attempts to move at least one of the golfer's hands, and a golf club shaft, within the appropriate space described by the set of rails throughout at least the extended portion of the golf swing.

BRIEF DESCRIPTION OF THE DRAWINGS

The invention is an apparatus for improving a golf swing. The invention will be more fully understood in conjunction with the following figures, wherein.

DETAILED DESCRIPTION

Figure 1:
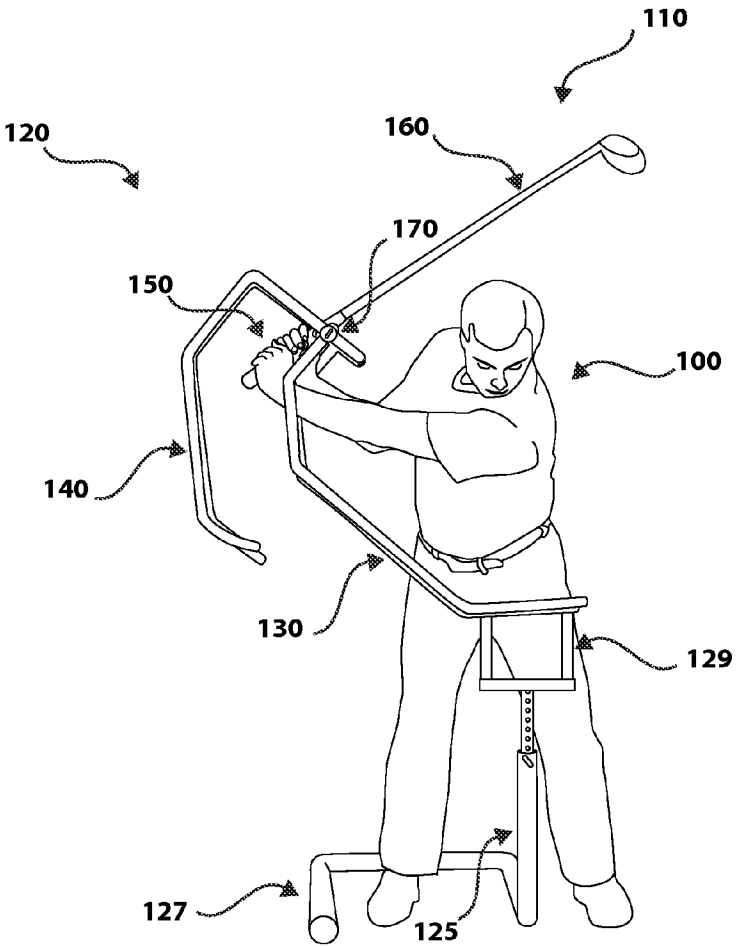
FIG. 1 is a front view of an embodiment of the apparatus during its usage.

FIG. 1 is a front view of a preferred embodiment of the invention during its use. A golfer 100 is shown during a golf swing, with a golf club 110 positioned at or near the top of a golf swing. The golfer can be at the end of practicing a backswing or at the beginning of a forward swing. A set of rails 120 is provided to help the golfer 100 improve his swing. The set of rails 120 are supported by a support structure 125, which in this figure is a support arm. The set of rails 120 as shown in this figure includes a pair of hand rails 130 and a pair of golf club shaft rails 140. The pair of hand rails 130 is configured to induce the golfer to move the golfer's hands 150 within the appropriate space described by the hand rails 130 throughout the entire golf swing. The pair of golf club shaft rails 140 is configured to induce a golfer to move a golf club shaft 160 within the appropriate space described by the golf club shaft rails 140 throughout the entire golf swing. In preferred embodiments, the set of rails 120 can be pivoted so as to change their angular orientation by bringing the distal end of the set of rails 120 closer to or further away from the golfer 100, for the purpose of accommodating different types of swings, for example. The rails can also be extended so as to also be useable to improve other portions of a swing, or other types of swings.

In other preferred embodiments, the set of rails 120 can be rotated about the vertical axis of the support arm 125. Such rotation can accommodate swings that are closer to, or farther from, the hips, than more traditional swings. The rotation can also accommodate swings that extend farther back or further forward than traditional swings. In still other preferred embodiments, the distance between the hand rails 130 and the golf club shaft rails 140 can be increased. An increase in the distance between the hand rails 130 and the golf club shaft rails 140 can change the level of the restriction of the swing. In other preferred embodiments the set of rails 120 includes at least one bumper 170 connected to the distal end of the set of rails 120 or certain pairs of rails 130, 140, to induce the golfer 100 to avoid extending the golfer's hands 150 and/or the golf club shaft 160 past the distal end of the set of rails. In the embodiment shown, the golf club shaft rails 140 protrude beyond the point where they are joined with the hand rails 130. This allows the golfer to extend the golf club beyond the point where the golf club shaft rails 140 and the hand rails 130 join.

Figure 2:
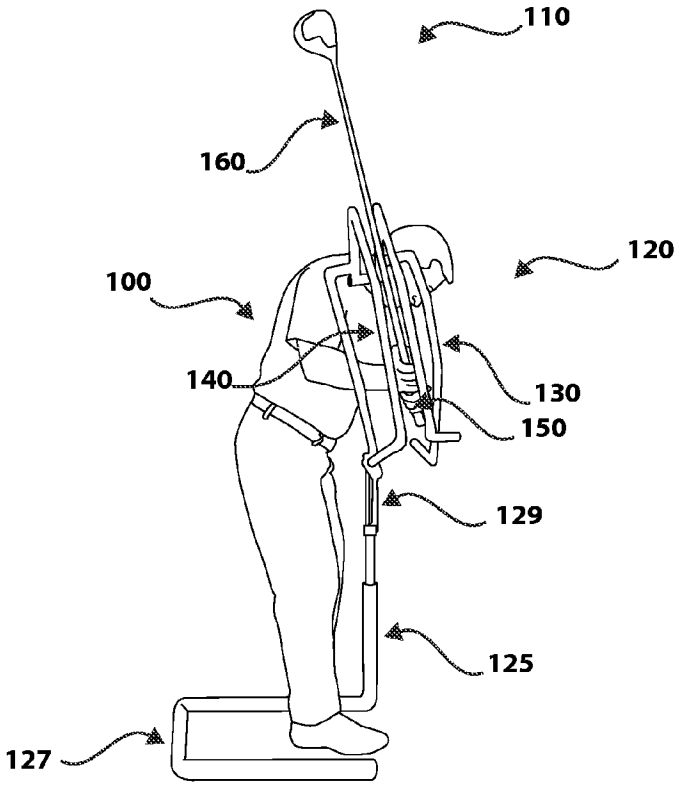
FIG. 2 is a side view of the embodiment shown in FIG. 1.

FIG. 2 is a side view of the preferred embodiment depicted in FIG. 1. In preferred embodiments, the width of the spacing between the certain pairs of the rails 130, 140 of the set of rails 120 can be adjusted to constrain the lateral deviation from the desired swing trajectory of the golfers' hands 150, and/or the golf club shaft 160, more or less strictly. In other preferred embodiments, the set of rails 120 can be rotated about the vertical axis of the support arm 125, or tilted forward or back so as to bring the distal end of the set of rails 120 behind, or in front of, the golfer. These features of adjustability can accommodate golfers of different heights and/or arm lengths, and/or golfers using different types of clubs and/or having different types of swings. As discussed in connection with FIG. 1, the distal end of the set of rails 120 can also be brought closer to, or further away from, the golfer 100. Also discussed in FIG. 1, the rails can be extended so as to also be useable to improve other portions of a swing, or other types of swings.

Figure 3:
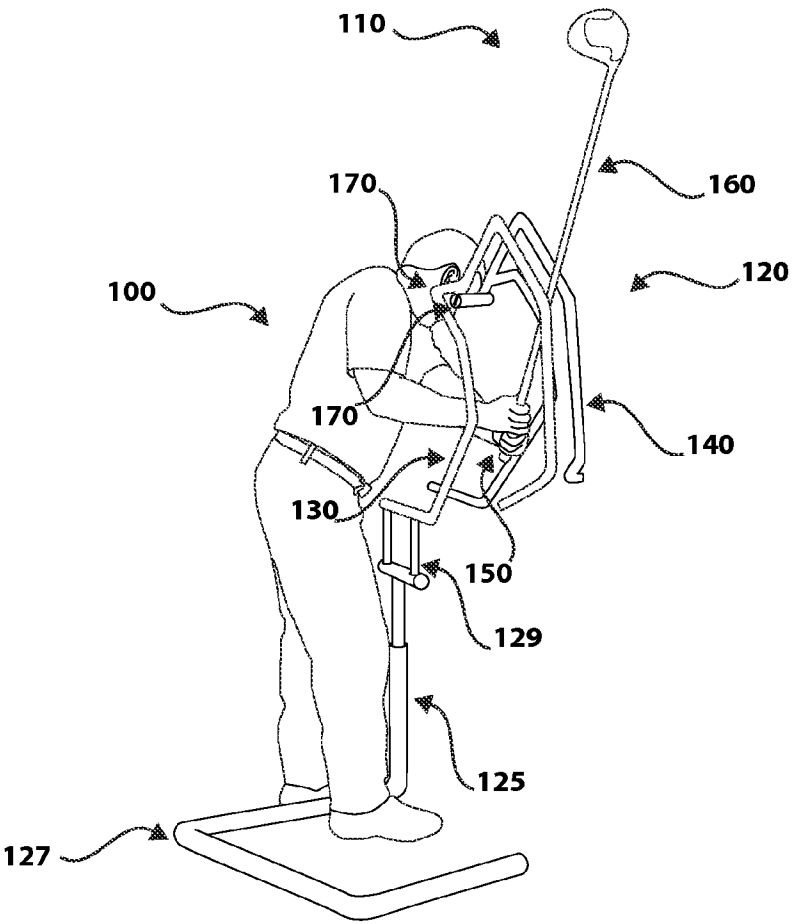
FIG. 3 is an oblique rear-side view of the embodiment shown in FIG. 1.

FIG. 3 shows a preferred embodiment of the invention in use, with a golfer's hands and golf club shaft moving between the pair of hand rails and the pair of golf club shaft rails, respectively. FIG. 3 is an oblique rear-side view of the preferred embodiment shown in FIG. 1, wherein a golfer 100 has positioned a golf club 110 at an intermediary stage of a golf swing. The golfer 100 can be in the latter portion of a backswing, or the beginning portion of a forward swing. As indicated in FIG. 3, the golfer 100 is induced to move his or her hands 150 within the appropriate space described by the hand rails 130, and to move the golf club shaft 160 within the appropriate space described by the golf club shaft rails 140.

In alternative preferred embodiments of the invention, the height of the set of rails 120 or certain pairs 130, 140 of the set of rails 120 is adjustable, to allow for its use by golfers of different heights and/or golf clubs of different lengths and types. The support arm 125 can be constituted in such a way as to allow vertical adjustment of the set of rails 120. For example, the support arm 125 can be a telescopically extendable arm. Alternatively, the support arm 125 can comprise another vertical adjustability mechanism such as a clamping system or a peg-and-hole system.

In other preferred embodiments, as discussed above in connection with FIG. 1 and FIG. 2, the angular orientation of the set of rails 120, or certain pairs of rails 130, 140 of the set of rails 120, can be adjustable, which can allow the plane of the golf swing to be adjustable, as may be appropriate for golfers of different heights and/or arm lengths, and/or golfers using different types of clubs and/or having different types of swings. In other preferred embodiments, the length of the set of rails 120, or certain pairs of rails 130,140 of the set of rails 120, can also be adjusted. For example, as discussed above in connection with FIG. 1 and FIG. 2, the rails can be extended so as to also be useable to improve other portions of a swing, or other types of swings. In other preferred embodiments, the set of rails 120 can be fully expanded, or alternatively fully contracted, for example for a golfer of a bigger or smaller size.

In preferred embodiments of the invention the set of rails 120 includes at least one bumper 170 connected to the distal end of the set of rails 120, or to the distal end of certain pairs of rails 130, 140 of the set of rails 120. The bumper 170 can induce the golfer 100 to avoid extending the golfer's hands 150 and/or the golf club shaft 160 past the distal end of the set of rails 120 or certain pairs of rails 130, 140 during the extended portion of a golf swing. In the embodiment shown, the golf club shaft rails protrude beyond the point where they are joined with the hand rails. This allows the golfer to extend the golf club beyond the point where the golf club shaft rails and the hand rails join. In some of the embodiments including a bumper 170 the bumper 170 can be alternatively extended and retracted, so as to change the position at which the arc of a user's swing will be stopped. The bumper 170 can be adjusted in this manner by adjusting the distal end of the set of rails 120 or certain pairs of rails 130, 140 for example.

As described above, the invention can be adjusted in a variety of ways. These adjustable features include the capability of fully expanding, or alternatively fully contracting, the set of rails 120, for example for a golfer of a bigger or smaller size. Moreover, the different pairs of rails 130, 140 can be adjusted independently of each other. Another potential element of the invention is a head training unit, not shown in the figures. The head training unit can be a separate unit that is attachable to the unit as shown in the figures. The head unit can enable a golfer to move their head backwards and/or up or down slightly, but can restrict the golfer's head from moving forward beyond the ball, and also restrict the golfer's head from being positioned at a different vertical height at the end of a swing, than at the beginning of the swing.

Figure 4:
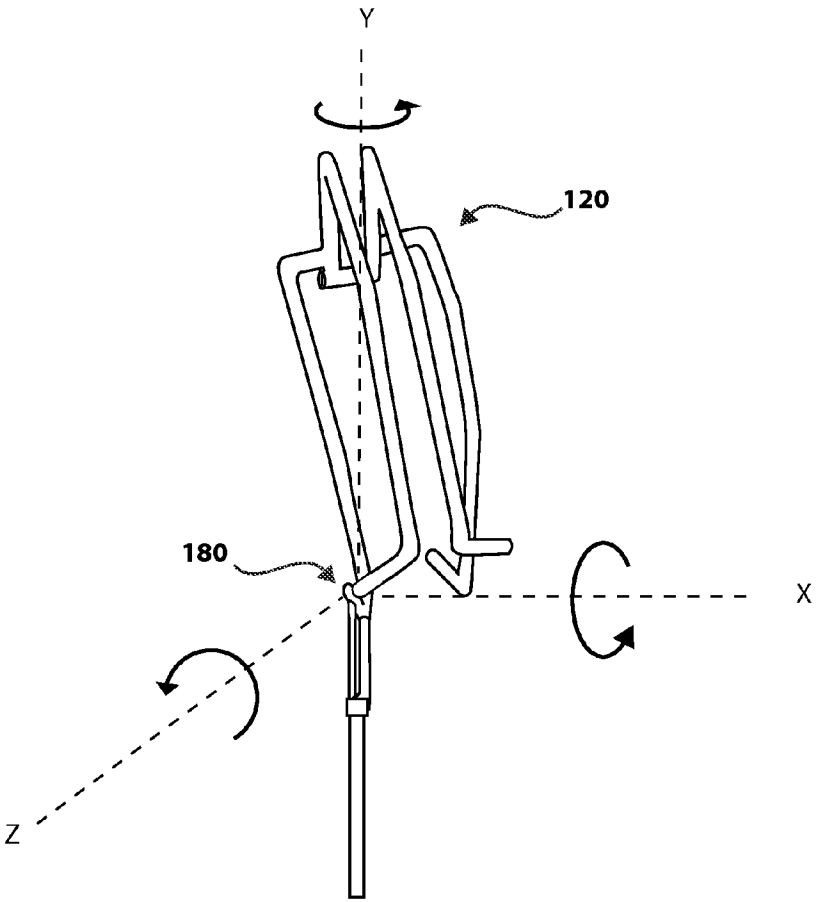
FIG. 4 is an illustration of the adjustability of the orientation of the set of rails of the apparatus shown in FIG. 1.

FIG. 4 is an illustration of the adjustability of the orientation of a set of rails of the apparatus shown in FIG. 1. The invention can include a variety of elements to accomplish adjustability features mentioned above. For example, the set of rails 120 can be connected to the support arm 125 by a hinge, which allows for adjustment of the angular orientation of the set of rails 120 in one dimension, or by a series of hinges, which allows for adjustment of the angular orientation of the set of rails 120 in several orthogonal dimensions. Alternatively, the set of rails 120 can be connected to the support arm 125 by a ball-and-socket type joint, which allows for rotation of the set of rails 120, and/or adjustment of the angular orientation of the set of rails 120, in any direction. FIG. 4 illustrates the manner in which a ball-and-socket joint can allow for rotation of the set of rails 120 relative to the support arm 125 in any of the three spatial dimensions.

Figure 5:
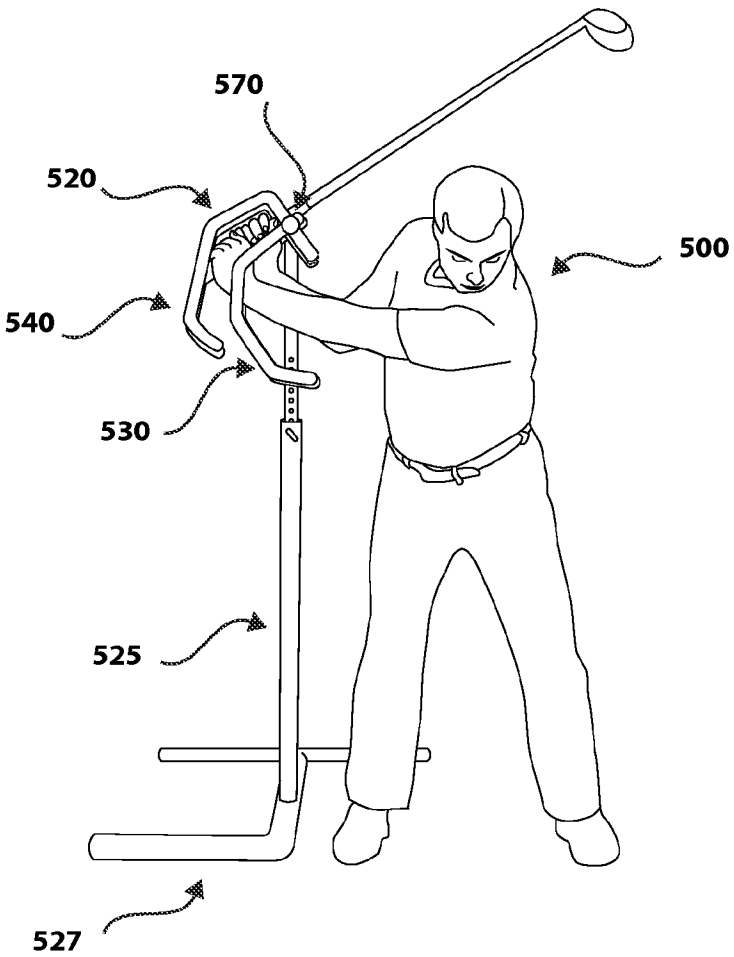
FIG. 5 is a front view of an alternative embodiment of the apparatus during its usage.

FIG. 5 is a front view of an alternative embodiment of the apparatus during its usage. In this embodiment, the set of rails 520 are shorter and thus out of view of the golfer 500 as the golfer practices their swing. The stand 525 shown in this figure is especially configured to support the shorter rails while not interfering with the stance of the golfer 500. The shorter rails 520 obstruct the golfer's downswing less than longer rails 120. This minimal obstruction can be useful for golfers who are particularly concerned with the upper portion of their swing. Furthermore, these rails can add to the desired challenge of executing a proper swing, by not an added visual aid within the golfer's field of vision. By allowing the golfer 500 the freedom to move their hands and club freely for a considerable portion of the swing, the set of rails 520 can serve as a feedback mechanism to indicate to the golfer 500 whether their natural instinctive movements are producing a proper swing.

Figure 6:
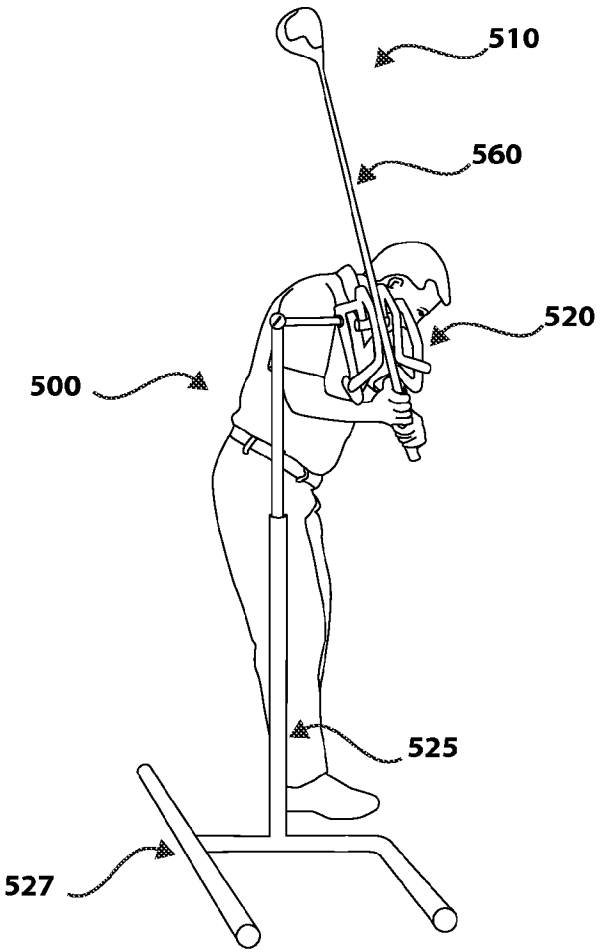
FIG. 6 is a side view of the embodiment shown in FIG. 5.
Figure 7:
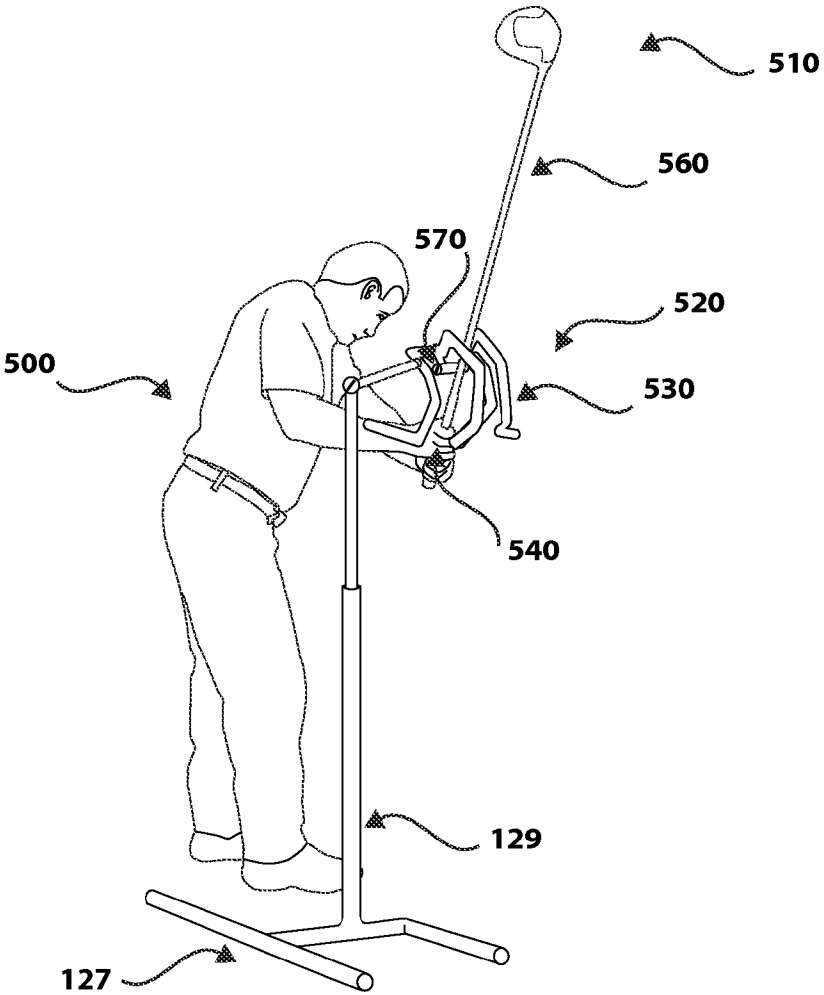
FIG. 7 is an oblique rear-side view of the embodiment shown in FIG. 5.

In the figure, a golfer 500 is shown during a golf swing, with a golf club positioned at or near the top of a golf swing. In preferred embodiments, the set of rails 520 can be pivoted so as to change their angular orientation by bringing the distal end of the set of rails 520 closer to or further away from the golfer, for the purpose of accommodating different types of swings, for example. The rails 520 can also be extended so as to also be useable to improve other portions of a swing, or other types of swings. Some types of golf swings which can benefit from the guidance offered by extended rails can include a pitch, a divot or sand-trap swing, or a put, for example. FIG. 6 is a side view of the embodiment shown in FIG. 5, and FIG. 7 is an oblique rear-side view of the embodiment shown in FIG. 5.

Figure 8:
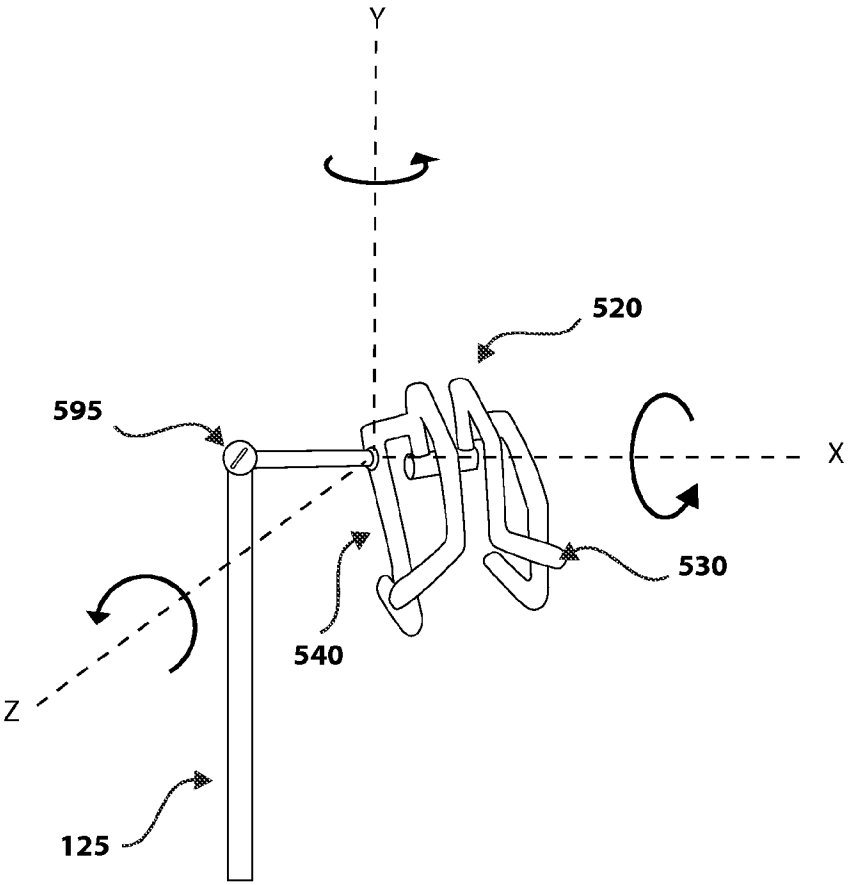
FIG. 8 is an illustration of the adjustability of the orientation of a set of rails of the apparatus shown in FIG. 5.

FIG. 8 is an illustration of the adjustability of the orientation of a set of rails 520 of the apparatus shown in FIG. 5. The invention can include a variety of elements to accomplish adjustability features mentioned above. For example, the set of rails 520 can be connected to the support arm 525 by a hinge, which allows for adjustment of the angular orientation of the set of rails 520 in one dimension, or by a series of hinges, which allows for adjustment of the angular orientation of the set of rails 520 in several orthogonal dimensions. Alternatively, the set of rails 520 can be connected to the support arm 525 by a ball-and-socket type joint, which allows for rotation of the set of rails 520, and/or adjustment of the angular orientation of the set of rails 520, in any direction. FIG. 8 illustrates the manner in which a ball-and-socket joint can allow for rotation of the set of rails 520 relative to the support arm 525 in any of the three spatial dimensions.

Certain adjustability mechanisms can also be used to adjust the set of rails 520, or certain pairs of rails 520, 530, in a variety of ways. For example, certain pairs of rails 520, 530 can be extendable via a telescoping system, a clamping system, or a peg-and-hole system. Furthermore, a spacing-adjuster mechanism can be employed to adjust the spacing between the rails in a variety of ways. The spacing-adjuster can be a peg-and-hole system, or a track system, for example. Other embodiments may occur to one skilled in the art, and would be within the scope of this application. The angle at which the rails are oriented relative to each other can also be adjusted, via a system of hinge joints, for example.

Figure 9A:
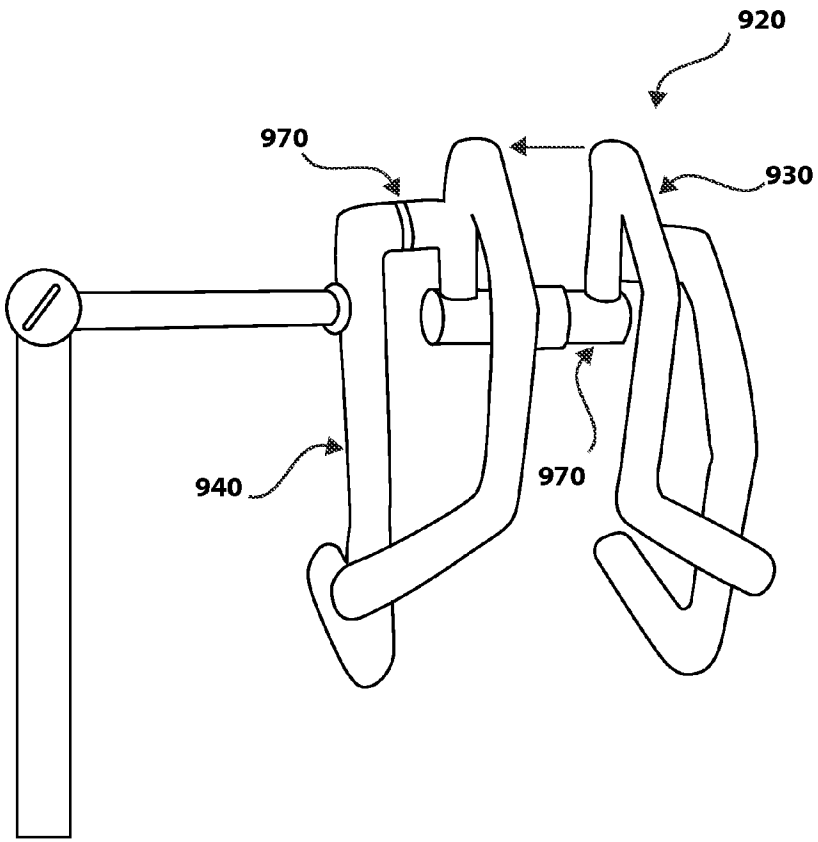
FIG. 9A is a side view of a set of rails of the apparatus, wherein the spacing between the rails of a given pair of rails is adjustable.
Figure 9B:
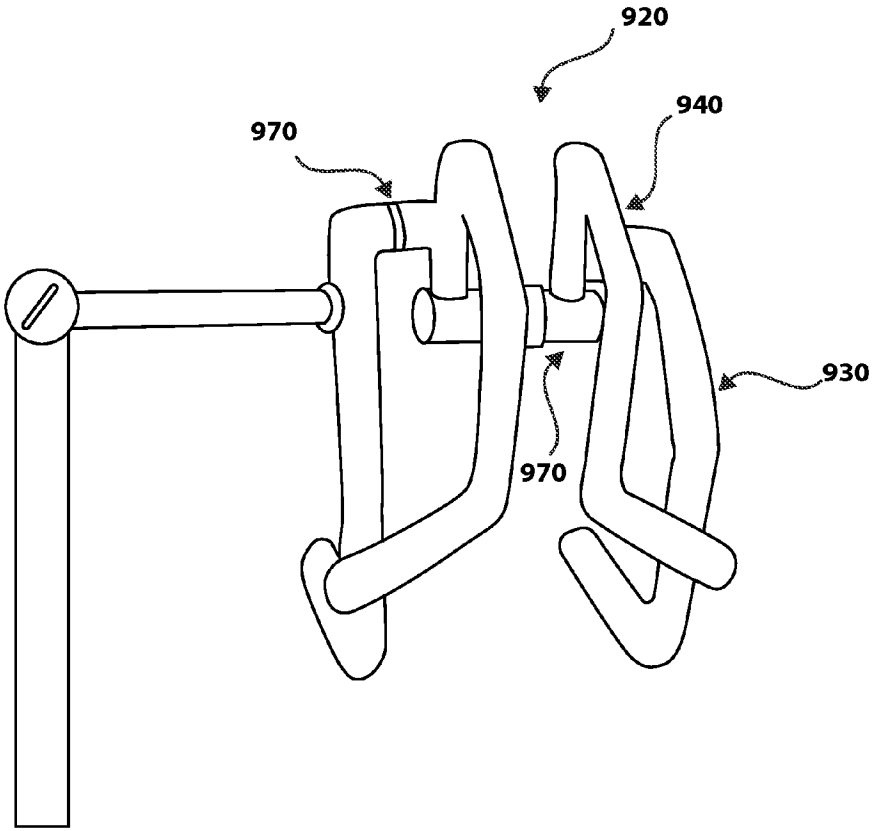
FIG. 9B is a side view of the set of rails of FIG. 9A, with the spacing between the rails of each pair of rails having been adjusted.

FIG. 9A is a side view of a set of rails 920 of the apparatus, wherein the spacing between the rails of a given pair of rails is adjustable. In this figure, the bumper is capable of being collapsed via a telescoping member 970, thereby bringing the golf club shaft rails 930 closer together. FIG. 9B is a side view of the set of rails of FIG. 9A, with the spacing between the rails of each pair of rails having been adjusted. In this figure, the golf club shaft rails 930 have been brought closer together via the bumper telescoping member 970. This has also brought the hand rails 940 together. The hand rails 940 can also include a space-adjustment member. This space adjuster can be a telescoping member, a pin-and-holes assembly, or a track system, for example. Other embodiments will be readily apparent to one of average skill in the art.

Figure 9C:
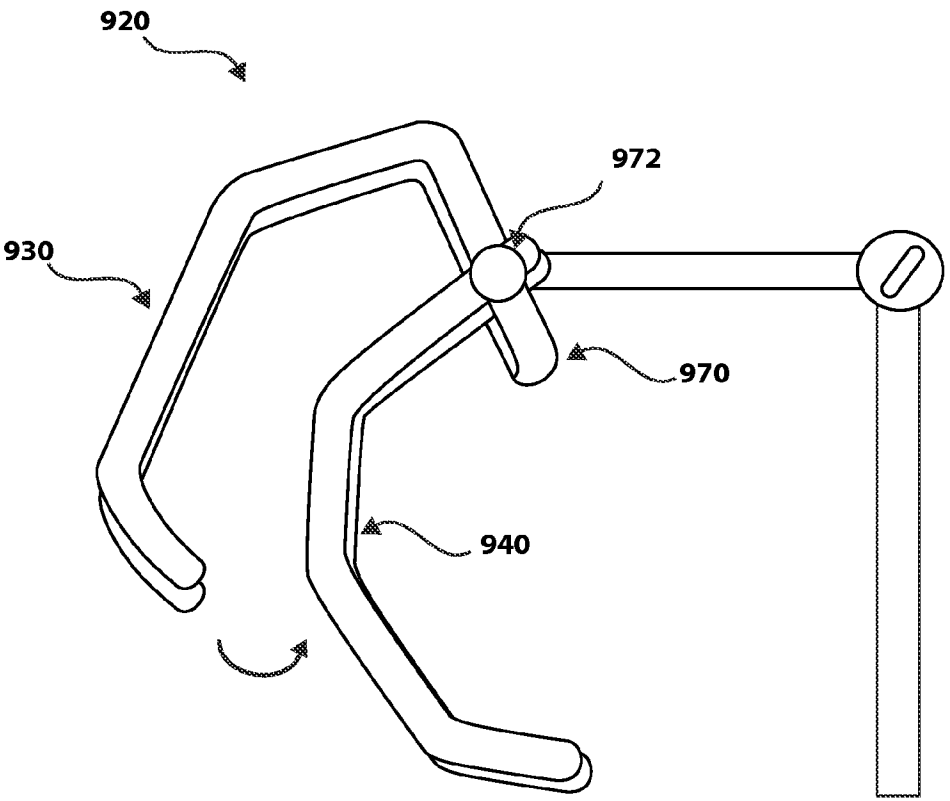
FIG. 9C is a front view of a set of rails of the apparatus, wherein the spacing between two separate pairs of rails is adjustable.
Figure 9D:
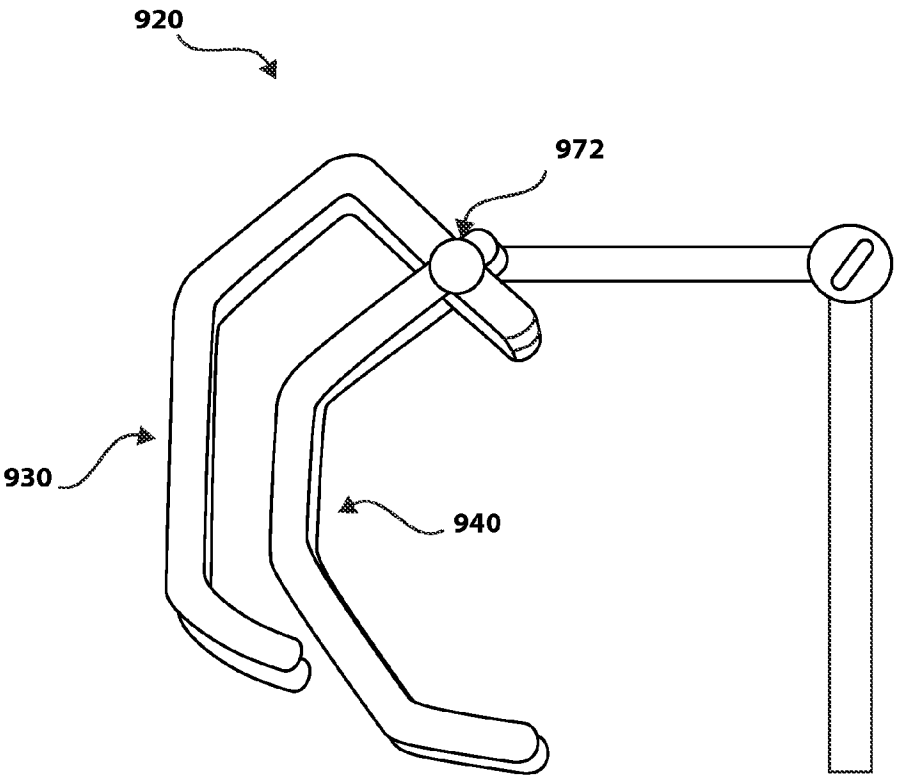
FIG. 9D is a front view of the set of rails of FIG. 9C, with the spacing between the pairs of rails having been adjusted.

FIG. 9C is a front view of a set of rails 920 of the apparatus, wherein the spacing between two separate pairs of rails 930, 940 is adjustable. In the embodiment shown, the adjustment mechanism is a hinge joint 972 located where the hand rails 940 and the golf club shaft rails 930 are joined. The hinge joint 972 allows the golf club shaft rails 930 to be pivoted closer to the hand rails 940. FIG. 9D is a front view of the set of rails of FIG. 9C, with the spacing between the pairs of rails having been adjusted. In the embodiment shown, the golf club shaft rails 930 are pivoted downwards, about the hinge joint 972. In other embodiments, the hand rails 940 can be pivoted about a hinge joint. In still other embodiments, the two pairs of rails can be brought closer together or farther apart via a track system, or a telescoping system, a pins-and-holes assembly, or other system apparent to one of ordinary skill in the art.

In some other preferred embodiments, the invention can further include an extension to the set of rails which can be attached and fastened into the original set of rails, for example by firmly fitting the extension in place, or snapping or clamping the extension in place, to a certain area of the original set of rails, for example. Such an attachment can be used to improve a pitch swing or putter swing, for example.

Figure 10A:
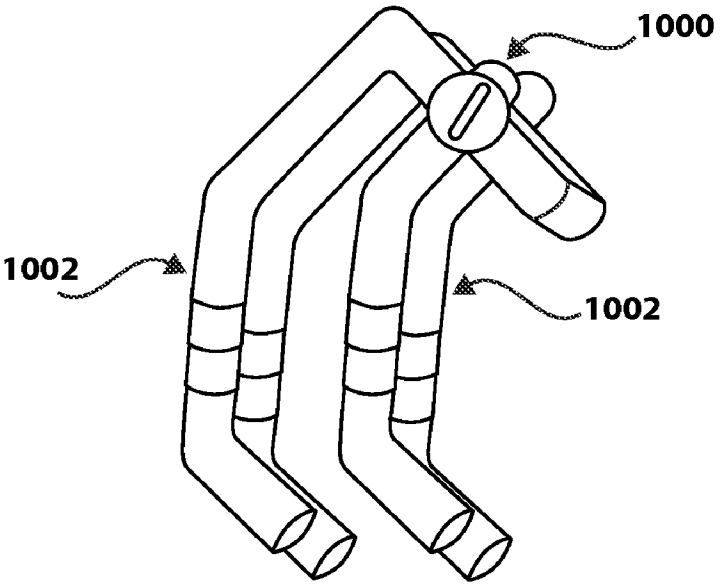
FIG. 10A is a side view of an embodiment of the apparatus with telescoping rails capable of being extended so as to increase the total length of the rails.
Figure 10B:
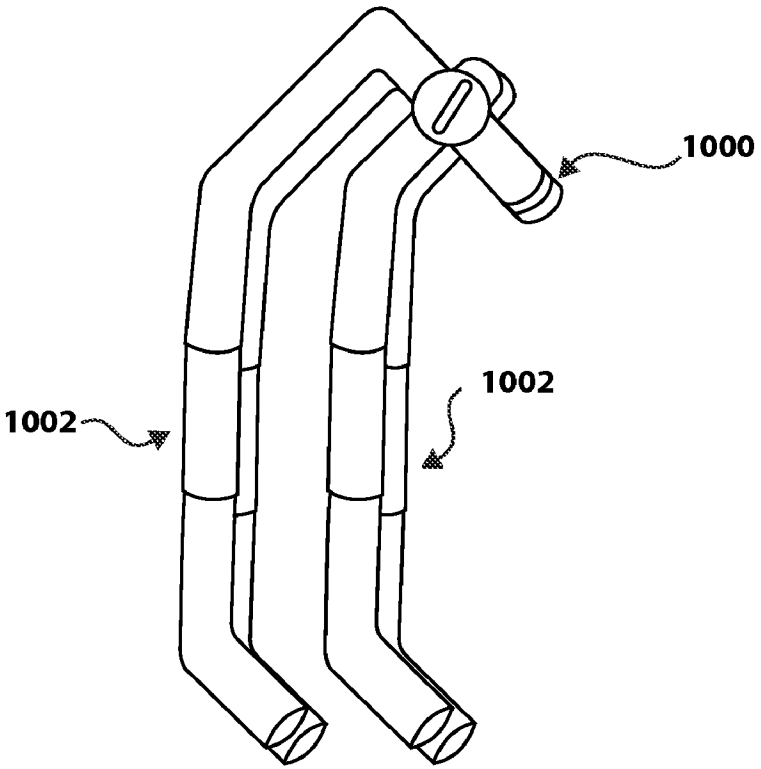
FIG. 10B is a side view of the embodiment shown in FIG. 10A, with the telescoping rails extended, thereby increasing the total length of the rails.
Figure 10C:
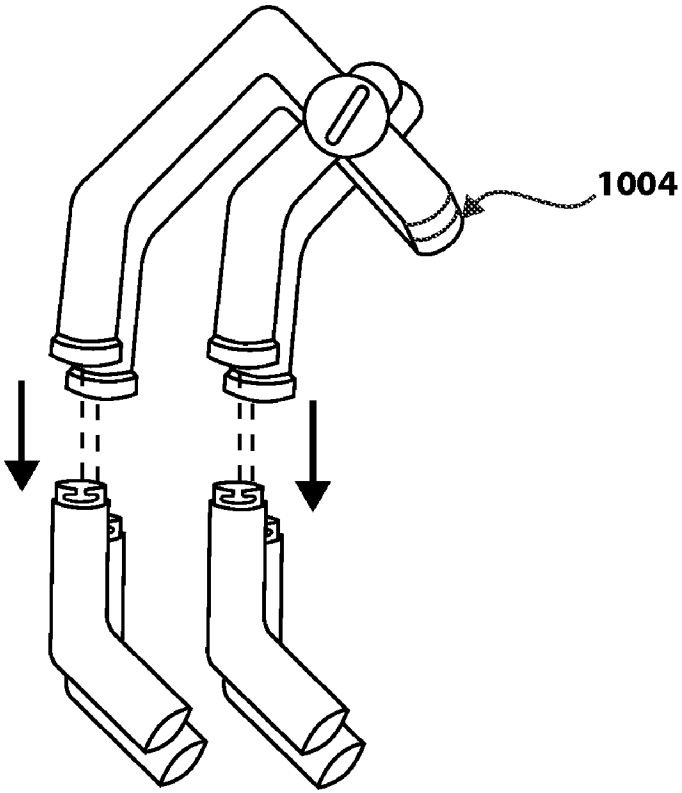
FIG. 10C is a side view of an embodiment of the apparatus capable of receiving attachable extension rails so as to increase the total length of the rails.
Figure 10D:
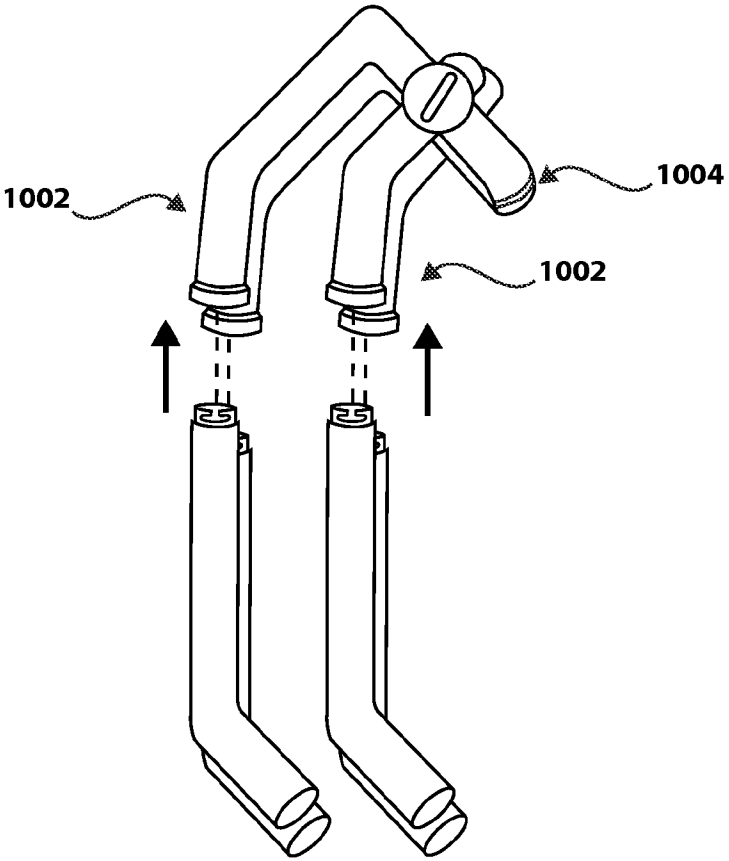
FIG. 10D is a side view of the embodiment shown in FIG. 10C, with attachable extension rails attached to the apparatus.

FIG. 10A is a side view of an embodiment of the apparatus with telescoping rails 1002 capable of being extended so as to increase the total length of the rails. FIG. 10B is a side view of the embodiment shown in FIG. 10A, with the telescoping rails 1002 extended, thereby increasing the total length of the rails. FIG. 10C is a side view of an embodiment of the apparatus capable of receiving attachable extension rails 1006 so as to increase the total length of the rails. FIG. 10D is a side view of the embodiment shown in FIG. 10C, with attachable extension rails 1006 attached to the apparatus. The rails can be extended in this manner, or in another manner apparent to one skilled in the art. In some embodiments, the rails can be extended substantially horizontally, so as to be usable for the potential purpose of guiding a golfer's putter swing, for example.

Figure 11:
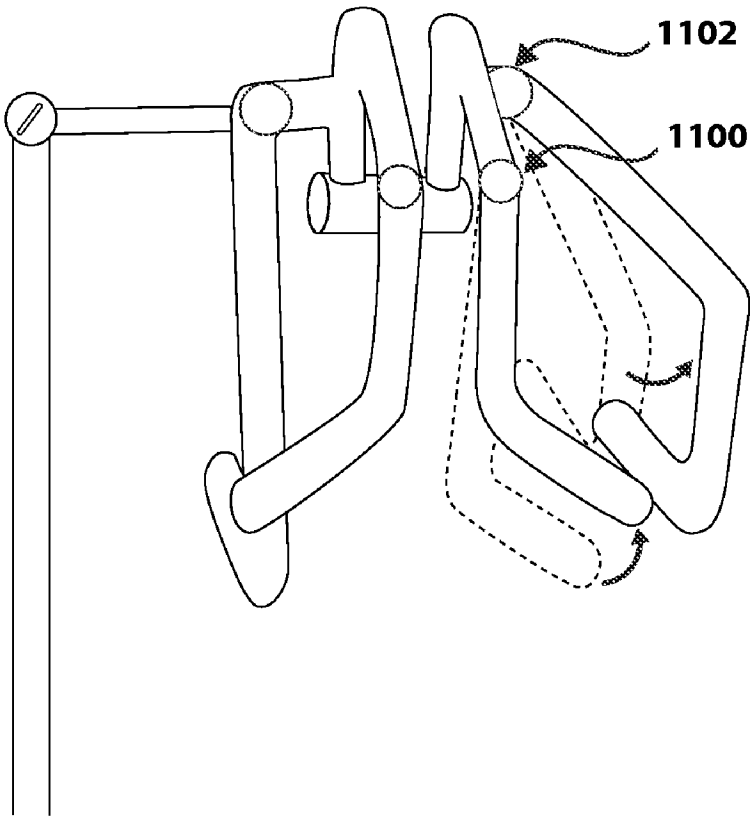
FIG. 11 is a side view of a set of rails of the apparatus, showing outward pivoting of a distal end of a rail via a hinge joint.

FIG. 11 is a side view of a set of rails of the apparatus, showing outward pivoting of a distal end of two outside rails via hinge joints 1100, 1102. The golf club shaft rail and/or the hand rail on the outside of the unit, can be pivoted outwards so as to allow the user to execute an upswing with greater arc. The rails can be pivoted via hinge joints 1100, 1102 located at different positions along the length of the rails, depending upon how much, or what portion, of a golfer's swing the golfer would like to restrict.

In other embodiments, the set of rails can be configured so as to enable a golfer to bring the golf club shaft within the golf club shaft rails, at or near the top of the swing. For example, a golfer whose upswing takes a non-traditional path, but whose downswing the golfer endeavors to improve and perfect, can take advantage of such configuration. The pair of golf club shaft rails can be opened at the top, or alternatively, the pair of golf club shaft rails can include a hinge mechanism that enables a user to bring the golf club shaft in between the rails of the pair of golf club shaft rails during the downswing.

Figure 12:
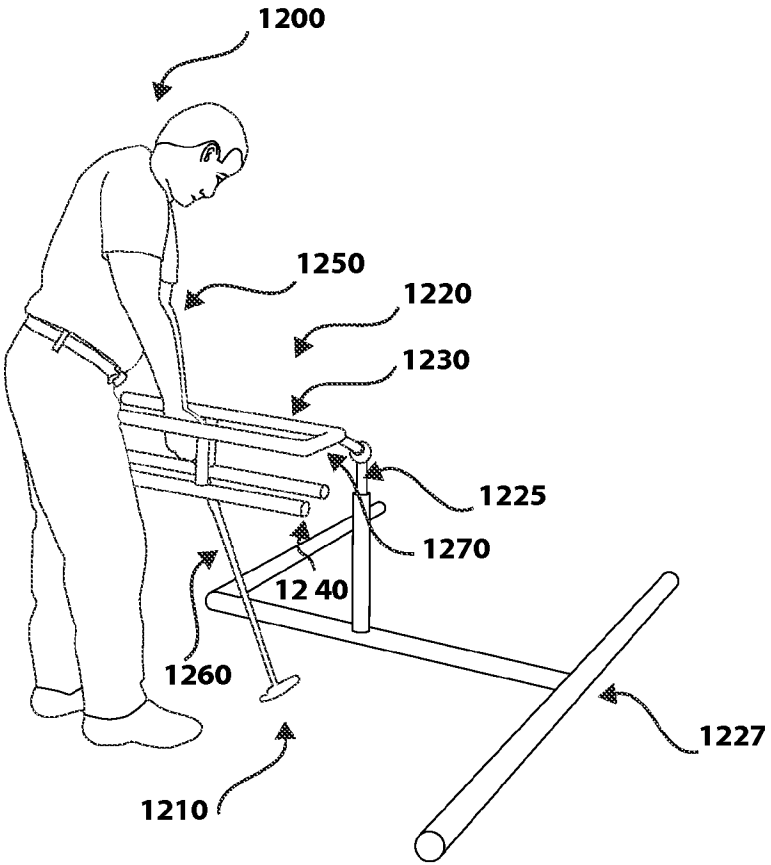
FIG. 12 is an illustration of an embodiment of the apparatus capable of being used for putting.

FIG. 12 is an illustration of an embodiment of the apparatus capable of being used for putting. Here, the rails are positioned substantially horizontally, to help guide a putter's swing. As with previously discussed embodiments, a set of rails 1220 is provided to help the putter 1200 improve his swing. The set of rails 1220 are supported by a support structure including a base 1227 and a vertical stand 1225, which in this figure is a support arm. The pair of hand rails 1230 is configured to induce the putter to move the putter's hands 1250 within the appropriate space described by the hand rails 1230 throughout the entire put. The pair of golf club shaft rails 1240 is configured to induce a putter to move a putter club shaft 1260 within the appropriate space described by the golf club shaft rails 1240 throughout the entire putter swing. A horizontal connector bar 1270 connects the rails together into fully integrated set of rails. The golf club shaft rails can be adjusted relative to the hand rails, to accommodate the angle at which the putter club is positioned relative to the golfer.

The invention or its parts, such as the support structure and/or the rails, can be made from a variety of materials, one preferable material being plastic, such as a soft, perhaps flexible plastic so as to avoid causing harm to a user of the invention. Another preferable material in some embodiments can be metal. In some embodiments the invention can also include padding, such as padding on the rails, for example. Furthermore, the invention can also have a feature which enables it to take a curved shape. For example, the rails may have a plurality of joints which can be manipulated so as to apply a curvature to the set of rails or certain pairs of rails. This may be desirable for a golfer whose swing is not a strictly planar swing. The apparatus can contain separable or adjustable elements which allow for both right-handed, and left-handed, use for golf swing training purposes.

Also disclosed is a method of improving a golf swing, comprising providing an apparatus as described above, and allowing a golfer to practice a golf swing, whereby the golfer attempts to move at least one of the golfer's hands, and a golf club shaft, within the appropriate space described by the set of rails throughout at least the extended portion of the golf swing.

Figure 13:
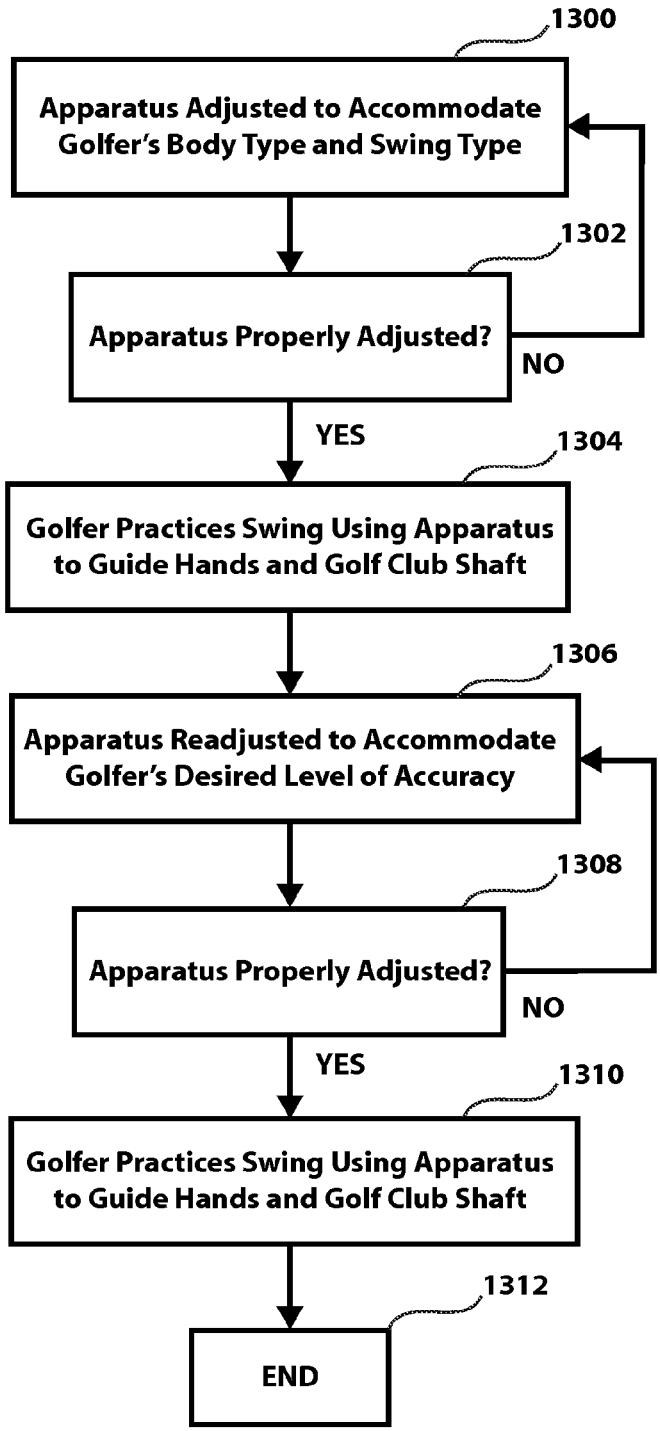
FIG. 13 is a flowchart depicting potential steps of usage of an embodiment of the apparatus.

FIG. 13 is a flowchart depicting potential steps of usage of an embodiment of the apparatus. First, the training apparatus is adjusted appropriately so as to accommodate the golfer's body type and swing type, and whatever other considerations are relevant to the golfer who is to be using the apparatus. Once the apparatus is determined to be properly adjusted, the golfer can practice their swing, using the training apparatus to guide the golfer's hands and the shaft of the golfer's club. If the golfer decides to readjust the apparatus to train a more accurate swing, or any other reason, the golfer can readjust and then continue practicing, until the golfer is finished using the apparatus.

Other modifications and implementations of the apparatus and method described above will occur to those skilled in the art, without departing from the spirit and the scope of the invention.

What is claimed is:

1. A training apparatus for improving a golfer's golf swing, comprising:

a support structure; and a set of rails supported by the support structure, the set of rails including:

at least two hand rails describing a hand space therebetween, the hand space defining an appropriate trajectory through which the golfer's hands should travel to achieve a desired golf swing, the hand rails for inducing the golfer to move the golfer's hands within the hand space and for constraining lateral deviation of the golfer's hands from the appropriate trajectory throughout at least a portion of the golf swing; and at least two shaft rails describing a golf club shaft space therebetween, the golf club shaft space having an appropriate trajectory through which the golfer's golf club shaft should travel to achieve a desired golf swing, the shaft rails for inducing the golfer to move a golf club shaft within the golf club shaft space and for constraining lateral deviation of the golf club shaft from the appropriate trajectory throughout at least a portion of the golf swing.

2. The apparatus of claim 1, wherein elevation of the set of rails to a height above the ground is adjustable.

3. The apparatus of claim 1, wherein at least one of: the hand rails, and the shaft rails has an adjustable length to increase or decrease the length of the portion of the desired swing that is constrained thereby.

4. The apparatus of claim 1, wherein a distance separating the hand rails can be adjusted to vary the constraint on the lateral deviation of the golfer's hands from the appropriate trajectory.

5. The apparatus of claim 1, further comprising means for adjusting the angle of orientation of the set of rails to alter the plane of the desired golf swing.

6. The apparatus of claim 5, wherein the means for adjusting are one or more hinges each permitting adjustment of the angle of orientation of the set of rails about a different orthogonal dimension.

7. The apparatus of claim 5, wherein the means for adjusting is a ball and socket joint permitting adjustment of the angle of orientation of the set of rails about three orthogonal dimensions.

8. The apparatus of claim 1, wherein:

the hand rails and the shaft rails are coupled together at the distal end of the set of rails;

the hand rails and shaft rails follow substantially the same trajectories; and the shaft rails extend further from the golfers body than the hand rails.

9. The apparatus of claim 1, wherein a bumper connects the distal ends of the shaft rails together, to define a distal end to the golf club shaft space and to induce a golfer to avoid extending a golf club past the distal ends of the shaft rails during a backswing portion of the desired golf swing.

10. The apparatus of claim 9, wherein the set of rails is configured to permit the golf club shaft to travel farther than the golfers hands during the backswing portion of the desired golf swing.

11. The apparatus of claim 10 wherein the shaft rails protrude beyond a point where they are coupled with the hand rails to permit the golf club shaft to travel farther than the golfers hands during the backswing portion of the desired golf swing.

12. The apparatus of claim 1 wherein a distance separating the shaft rails can be adjusted to vary the constraint on the lateral deviation of the golf club shaft from the appropriate trajectory.

13. A method for improving a golfer's swing of a golf club, said method comprising:

swinging the golf club while concurrently:

inducing the golfer to move the golfer's hands within a hand space defined by a distance of separation between at least two handrails, the hand space describing an appropriate trajectory through which the golfer's hands should travel to achieve an improved golf swing, the hand rails constraining lateral deviation of the golfer's hands from the appropriate trajectory throughout at least a portion of the golf swing; and inducing the golfer to move the golf club's shaft within the golf club shaft space, the golf club shaft space defined by a distance of separation between at least two shaft rails, the club shaft space describing an appropriate trajectory through which the golf club shaft should travel to achieve a desired golf swing, the shaft rails constraining lateral deviation of the golf club shaft from the appropriate trajectory throughout at least a portion of the golf swing.

14. The method of claim 13 further comprising elevating the hand rails and the shaft rails to a height above the ground appropriate to achieving the desired swing in view of the golfer's stature.

15. The apparatus of claim 13 further comprising adjusting lengths of the hand rails and the shaft rails to determine the portion of the desired swing that is to be constrained by the rails.

16. The method of claim 13 further comprising adjusting a distance separating the hand rails to determine a degree of constraint on the lateral deviation of the golfer's hands from the appropriate trajectory during a swing.

17. The method of claim 13 further comprising adjusting a distance separating the shaft rails to determine a degree of constraint on the lateral deviation of the golf club shaft from the appropriate trajectory during a swing.

18. The method of claim 13 further comprising adjusting an angle of orientation of the hand and shaft rails to establish an appropriate plane for the desired golf swing.

19. The method of claim 18 wherein said adjusting the angle of orientation is accomplished using one or more hinges each permitting adjustment of the angle of orientation of the hand and shaft rails about a different orthogonal dimension.

20. The method of claim 19 wherein said adjusting the angle of orientation is established using a ball and socket joint permitting adjustment of the angle of orientation of the hand and shaft rails about three orthogonal dimensions.

21. The method of claim 13 further comprising inducing the golfer to avoid extending the golf club past the distal ends of the shaft rails during a backswing portion of the desired swing.

* * * * *